United States Patent [19]

Chen et al.

[11] Patent Number: 4,936,882

[45] Date of Patent: Jun. 26, 1990

[54] FLUID DYNAMIC COOLING TOWER

[76] Inventors: Jia H. Chen, 10th Fl., 202, Sec. 3, Hsinyi Rd.; Chu Chiang-Lai, 4th Fl. 115, Sec. 1, Tong Ho E. Rd., Shih Lin District, both of Taipei, Taiwan

[21] Appl. No.: 355,331

[22] Filed: May 22, 1989

[51] Int. Cl.[5] ..... B01F 3/04

[52] U.S. Cl. ..... 255/257.2; 55/257.5; 239/455; 239/424; 261/DIG. 11; 261/116

[58] Field of Search ..... 261/DIG. 11, 116; 255/257.2, 257.5; 239/455, 424, 428.5

[56] References Cited

U.S. PATENT DOCUMENTS

| | | | |
|---|---|---|---|
| 1,186,208 | 6/1916 | Kent et al. | 55/257.5 |
| 1,272,031 | 7/1918 | Gohmert | 239/455 |
| 2,032,404 | 3/1936 | Fisher | 261/116 |
| 2,889,140 | 6/1959 | Koch | 261/116 |
| 3,702,175 | 11/1972 | Watkins | 239/424 |
| 3,807,145 | 4/1974 | Engalitcheff, Jr. et al. | 55/257.2 |
| 4,028,440 | 6/1977 | Engalitcheff, Jr. | 261/DIG. 11 |
| 4,206,876 | 6/1980 | Koch | 239/455 |
| 4,270,702 | 6/1981 | Nicholson | 239/455 |
| 4,591,463 | 5/1986 | Nahra et al. | 261/116 |

*Primary Examiner*—Tim Miles

*Attorney, Agent, or Firm*—Asian Pacific International Patent and Trademark Office

[57] ABSTRACT

An injection cooling tower includes an injection tubular element having an elongated slit made thereon along axial direction through which a pressure forced hot liquid flow induced from outside is ejected to form into a continuous screen of high velocity liquid flow rapidly toward a diffuser wherein the kinetic energy of the continuous screen of high velocity liquid flow is converted into a pressure energy to result in a negative pressure to suck in cooled air current from outside so as to let the cooled air current mix with the continuous screen of high velocity hot liquid flow to start a heat exchanging process. The heat absorbed air current is further exhausted out of the tower through the top exhaust outlet where a mist eliminator is set, while the cooled liquid flow is guided by a turning vane to run into a bottom water storage tank from which the water is pumped by a water pump for further application.

6 Claims, 5 Drawing Sheets

FIGURE. 2

FLUID DYNAMIC COOLING TOWER

BACKGROUND OF THE INVENTION

The present invention is related to a cooling tower and, more particularly to a kind of fluid dynamic cooling tower which injects liquid flow to form into a continuous screen of high velocity liquid flow to suck in cooling air from outside to make a heat exchanging process so as to achieve a cooling process.

In various industries, hot liquid flow may be produced during operation, and the heated liquid flow must be cooled down for another application. In the following discussion, the liquid flow indicates the water. However, the cooling tower of the present invention is also practical for use to cool down other liquid flow.

Currently, the most popularly used apparatus to cool down heated liquid flow is the cooling tower. Conventional cooling towers include two types, one is the forced draft type cooling towers and the other is the induced draft type cooling towers. In the forced draft type cooling towers, air fan is installed in the ground to force outside fresh air into cooling tower through conduit pipe so as to let the forced air be in contact with hot water to cool down the water. In the induced draft type cooling towers, induction fan is attached to cooling tower to induce air. Because induction fan is normally set at the top of the associated cooling tower, no conduit pipe is required in the induced draft type cooling towers.

In conventional forced draft type or induced draft type cooling towers, water flow which passes through cooling tower may be running along a reverse direction against air current or running to intersect air current. In either type of cooling towers, a heat exchanger which comprises beehive inner packing structure is installed inside a cooling tower to enlarge the contact area of water with air current.

Generally, a forced draft type cooling tower requires relatively a simple structure and less structural strength, because it needs not to support air fan or the related conduit pipe. However, because outside air is indirectly directed into cooling tower to exhaust through an air outlet far away from air inlet, the cooling effect is not as so good as expected.

In induced draft type cooling tower, outside air is uniformly induced into the lower portion of the tower through various air inlets made around the tower. Therefore, the cooling effect in induced draft type cooling towers is substantially better than forced draft type cooling towers. However, the structural strength of an induced draft type cooling tower must be reinforced so as to support induction fan. Because induction fan is set at the top of a tower to increase cross-sectional area, the structure of induced draft type cooling tower shall be made of steel or other reinforced material to resist against strong wind force. However, steel material is expensive and tends to get rusted to shorten the service life of a cooling tower. Further, steel structure is inconvenient to transport and difficult to build-up at job-site. Although some other plastic materials like FRP and etc., have been used to partly replace steel structure, the cost is still high.

Either in induced draft type or forced draft type cooling towers, air fan and motor are requisite for a cooling tower to work. In case a big scale of cooling tower is installed, supplementary accessories and mechanism such as driving shaft and reduction gear shall be equipped. In consequence, space consumption, installation cost and operational noise figure are inevitably increased. In conventional cooling towers, condensed water drips may be carried by air current to diffuse out of the towers because mist eliminator can not be installed in the air outlet.

U.S. Pat. No. 3,807,145 to Engalitcheff, Jr. et at. shows an injection cooling tower which is composed of a chamber having a mouth, a throat, a diffusion region and an exhaust opening. Water is injected into the throat and induces air flow into the mouth as well as mixed concurrent, generally horizontal flow in the diffusion region. Heat laden with saturated air is discharged from the exhaust opening and cooled water is collected adjacent to the exhaust end of the chamber. Because said injection cooling tower does not require the use of motor and air fan or induction fan to force or induce air draft to perform heat exchanging process, noise figure can be minimized during operation. However, the vaporous water flow can only induce a limited amount of air current which provides limited pressure.

SUMMARY OF THE INVENTION

The present invention is to provide a kind of injection cooling tower which includes a vertical injection tubular element having an elongated slit made thereon along axial direction, which slit is adjustable by means of adjusting screws. The heated liquid flow is forced into the vertical injection tubular element to inject through the slit to form into a continuous screen of high velocity liquid flow, which continuous screen of high velocity liquid flow rapidly runs into a diffuser. The diffuser is comprised of a front reducing area, a middle and a rear expanding area. In the front reducing area, the continuous screen of high velocity liquid flow results in a negative pressure effect to suck in a big amount of cooled air current to mix with the heated water flow and to perform a heat exchanging process. In the middle and rear expanding areas, the mixed flow of air current and liquid flow is boosted to produce a high exhaust pressure so as to let air current be rapidly exhausted out of the tower through an exhaust outlet set at the top of the tower, wherein a mist eliminator is installed. The liquid flow of the mixed flow is stopped by a turning vane to run into a bottom water storage tank from which the cooled water is pumped up for further application by a water pump.

In the said injection cooling tower of the present invention, no air fan is used, and the related conduit pipe can be eliminated. The present invention can provide a high performance of cooling effect better than conventional force draft type cooling tower. Further, unlike the expensive steel structure of the conventional induced draft type cooling tower which is easy to get rusted, the structure of the present invention can be made of rust-proof and inexpensive plastic material.

The present invention is also different from the injection cooling tower present by Engalitcheff Jr. et al. In the present invention, the continuous screen of high velocity liquid flow injected through an injection tubular element can suck in a big amount of cooled air current to fully mix with the heated liquid flow in a diffuser so as to perform a high effective heat exchanging process. By means of the design of the expanding rear area of the diffuser, the kinetic energy of the air-water mixed flow is converted into an exhaust pressure to let the hot air current produced from heat exchanging process be rapidly exhausted out of the tower through a top exhaust outlet, and in consequence, the inlet amount of air current sucked into the tower is relatively increased. Therefore, the present invention can provide good cooling effect much better than the prior art.

In conclusion, the main object of the present invention is to provide a high performance cooling tower which minimizes water loss rate and space consumption, and produces low noise figure during operation.

BRIEF DESCRIPTION OF THE DRAWINGS

The invention as well as its many advantages may be further understood by reference to the following detailed description of drawings in which.

DETAILED DESCRIPTION OF THE PREFERRED EMBODIMENTS

Figure 2:
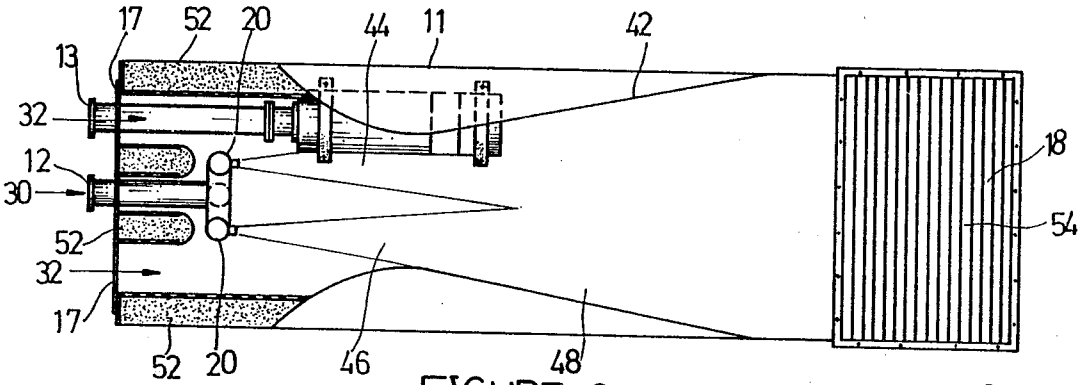
FIG. 2 is a top view of the embodiment of FIG. 1.
Figure 1:
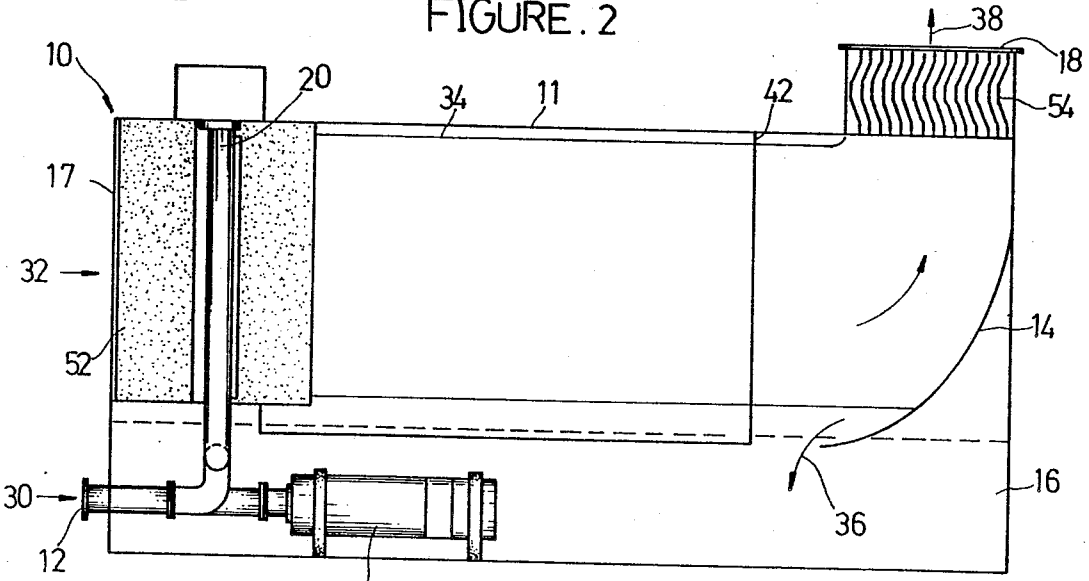
FIG. 1 is a side elevation of a cooling tower embodying the present invention.
Figure 3:
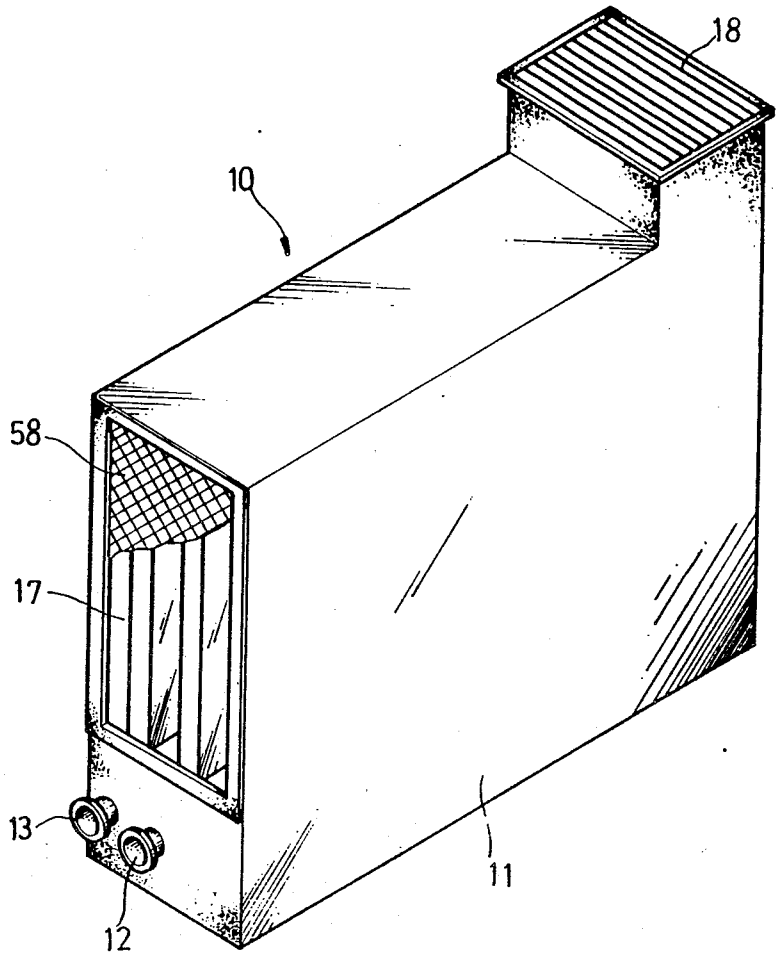
FIG. 3 is a perspective top view of the embodiment of FIG. 1.

Referring to the annexed drawings, the present invention is to provide a cooling tower 10 which includes an injection tubular element 20 through which heated water flow 30 is injected to form into a continuous screen of high velocity water flow 34, which continuous screen of water flow 34 produces a negative pressure to induce outside cooling air current 32 to mix with the heated water in a diffuser 42 so as to perform a heat exchanging process. The cooled water flow 36 resulted from the heat exchanging process is stopped by a turning vane 14 to run into a storage tank which is set at the bottom portion of the tower 10, while the hot air current 38 is guided by a turning vane 14 to rapidly exhaust out of the tower 10 through the top exhaust outlet 18.

The cooling tower 10 is comprised of a shell 11 to hold all component parts thereinside. The shell 11, which may either be made of stainless steel or polyethylene or other inexpensive plastic materials, is having a rectangular configuration and comprising a water inlet 12 and a water outlet 13 respectively set at the front side at lower end, an air inlet 17 set at the front side, and an exhaust outlet 18 set at the top side at an opposite end.

Figure 4:
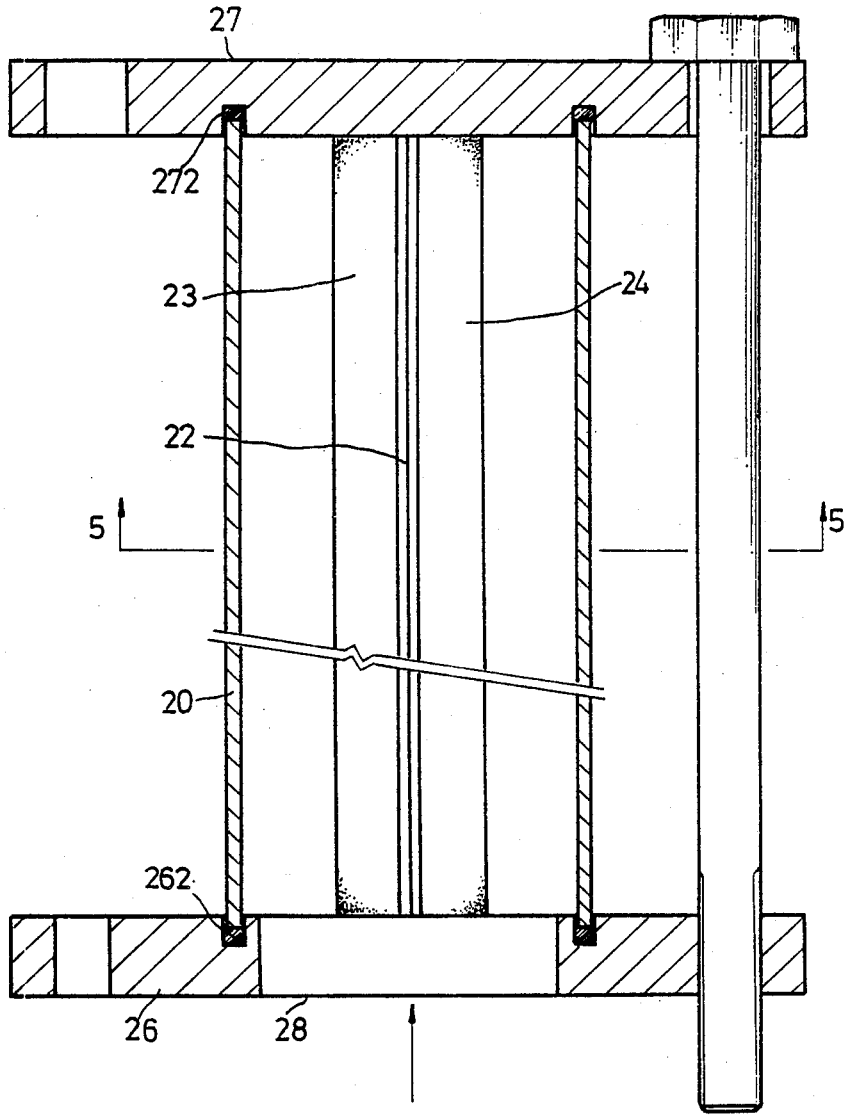
FIG. 4 is an enlarged back view of the injection tube used in the embodiment of FIG. 1.
Figure 5:
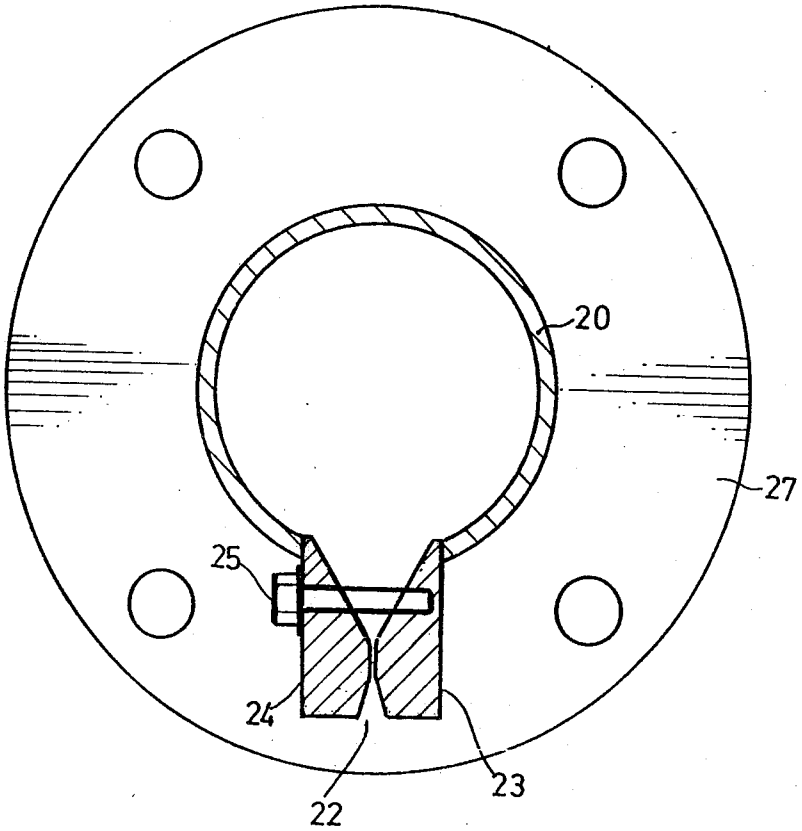
FIG. 5 is a sectional view taken on line 5—5 of FIG. 4.

The injection tubular element 20 is vertically set at the back side of the air inlet 17. According to the present invention, one or more injection tubular elements 20 may be used in a cooling tower through parallel connection, wherein the number of injection tubular elements 20 to be used is determined according to the width of the shell 11. Please refer to the enlarged drawings of the injection tubular element 20 as shown in FIGS. 4 and 5. The injection tubular element 20 is having a slit 22 made thereon along axial direction and defined by one pair of symmetric, flexible and wedge-shaped strip elements 23 and 24, wherein the two wedge-shaped strip elements 23 and 24 are fixedly mounted on the injection tubular element 20 to determine the width of the slit 22 therebetween by means of several adjusting screws 25. The both ends of the injection tubular element 20 are respectively set in the circular recess of the flanges 26 and 27 and tightly sealed by water seals 262 and 272 to prevent from water leakage. The flange 26, a collar flange, which is set at bottom end of the injection tubular element 20 forms into a water inlet 28 through which liquid flow is induced into the injection tubular element 20. The top end of the injection tubular element 20 is tightly sealed by the other flange 27, a blind flange. Therefore, the liquid flow which is induced into the injection tubular element 20 from the water inlet 28 of the flange 26 will be squeezed to inject through the slit 22. According to the present invention, heated liquid flow 30 or more particularly heated water flow is forced by high pressure to run into the injection tubular element 20 from the water inlet 12. When the heated liquid flow 30 is passing through the slit 22, the pressure energy of the heated liquid flow 30 is converted into kinetic energy, and therefore, the heated liquid flow 30 is injected through the slit 22 to form into a continuous screen of high velocity liquid flow 34. Therefore, the slit 22 serves as a injection nozzle in the present invention.

Because the injection tubular element 20 is set at the back side of the air inlet 17 to inject continuous screen of high velocity water flow toward the inner side of the cooling tower 10, the negative pressure resulted from the continuous screen of high velocity liquid flow will induce a big amount of cooled air current to run into the cooling tower 10 through the the air inlet 17. The induced air current and the liquid flow are simultaneously run along same direction into a diffuser 42 which is set inside the cooling tower 10. The diffuser 42 is comprised of a front reducing area 44, a middle expanding area 46 and a rear expanding area 48. The front reducing area 44 is also called jet suction inlet area. Because the continuous screen of high velocity water flow 34 injected through the slit 22 of the injection tubular element 20 produces a negative pressure resulted from the change of pressure energy into kinetic energy to provide a jet suction inlet, a big amount of outside cooled air current is induced into the front reducing area 44. In the middle expanding area 46, air current and water flow are getting in contact with each other to produce a turbulent mixing effect. In the rear expanding area 48, air current and water flow are fully mixed. In the middle and rear expanding areas 46 and 48, the kinetic energy of the mixed flow is gradually converted into pressure energy in accordance with the increasing of sectional area. Therefore, the middle and rear expanding areas 46 and 48 can help the mixing of the water flow with the induced cooled air current to accelerate cooling process, and also help the formation of pressure increasing to facilitate exhausting of air current.

Further, a turning vane 14 is set in the outlet of the diffuser 42 to guide the mixed flow of the water flow and air current to smoothly exhaust out of the cooling tower so as to minimize pressure loss. By means of the guiding of the turning vane 14, the air current 38 which has absorbed heat energy and become pressure-boosted is guided to rapidly exhaust out of the cooling tower through the top exhaust outlet 18, while the cooled water flow 36 is stopped by the turning vane 14 to flow downward into the bottom storage tank 16. The cooled water in the storage tank 16 is further pumped out of the cooling tower by a water pump 50 for other industrial application, for example, for cooling down centralized air conditioner system.

A silencer 52 is set by the air inlet 17 and the injection tubular element 20 to absorb the noise produced during the mixing of cooled air current with the water flow injected through the injection tubular element 20. An air filter 58 is also provided to completely cover the whole air inlet to filtrate the dust and particles carried in the induced air current.

A mist eliminator 54 is set in the exhaust outlet 18 to collect water drips carries in the hot air current 38 so as to reduce water loss down to 0.1% and below, which mist eliminator 54 is composed of several corrugated strip elements arranged in parallel with one another.

Figure 6:
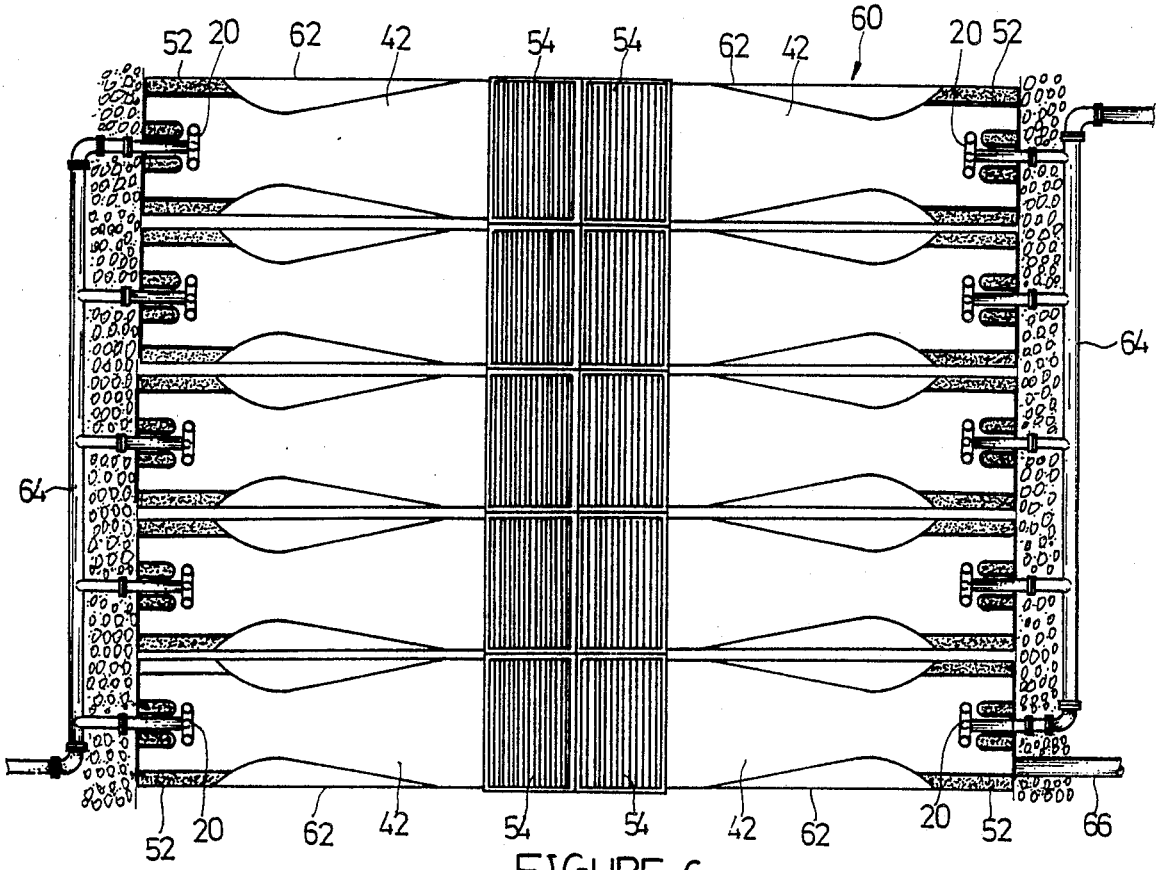
FIG. 6 is a top view of a second embodiment according to the present invention, wherein several cooling towers are connected together, through parallel connection, to form into a big scale cooling tower.
Figure 7:
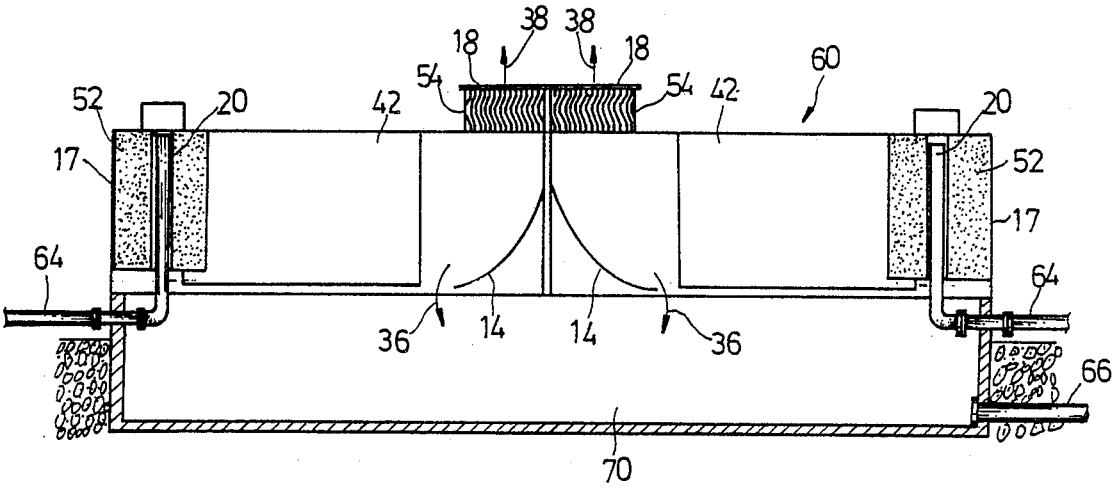
FIG. 7 is a side elevation of the embodiment of FIG. 6.

FIGS. 6 and 7 illustrate a big scale cooling tower combination set 60 comprised of several pairs of small cooling towers 62 oppositely disposed in two rows and set in the top surface of a concrete water tank 70, wherein the small cooling towers 62 each is comprised of the component parts of vertical injection tubular element 20, diffuser 42, turning vane 14, silencer 52, mist eliminator 54, air inlet 17 and exhaust outlet 18. The big scale cooling tower combination set 60 includes a water circulation system comprised of a feed water pipe 64, an exhaust water pipe 66, a water storage tank 70, and a big scale circulating water pump, wherein the circulating water pump (not shown) is set at a proper position outside the water storage tank 70, wherein pressure-forced water flow is equally distributed by the feed water pipe 64 to the injection tubular elements 20 of the small cooling towers 62 to produce continuous screens of high velocity water flow. When the water flows from the small cooling towers 62 are injected into respective diffusers 42, they are immediately mixed with respective cooled air currents. After heat exchanging process, the respective hot air currents 38 are exhausted out of respective cooling towers 62 through respective exhaust outlets 18, while the respective cooled water flows 36 are guided by respective turning vanes 14 to flow into the large water storage tank 70 from which the cooled water is pumped out by the big circulating water pump through the exhaust water pipe 66 for further application.

As above described, in the injection water cooling tower 10 or 60, an injection tubular element is used to inject pressure-forced hot water flow toward a diffuser, so as to let negative pressure suck in big amount of outside cooled air current to mix with and cool down the hot water flow and boost exhaust pressure. Therefore, according to the present invention, a cooling tower does not require air fan and air conduit pipe, of which the whole structure can be simplified and the size can be minimized. The structure of a cooling tower according to the present invention can be made of rust-proof plastic material to reduce the cost. Because the present invention can suck in big amount of cooled air current to perform heat exchanging process and greatly boost exhaust pressure, the cooling efficiency is proved much better than conventional spraying type cooling towers.

As indicated, the structure herein may be various embodied. Recognizing various modifications will be apparent, the scope hereof shall be deemed to be defined by the claims as set forth below.

We claim:

1. A cooling tower, including:

a shell comprising an air inlet and an exhaust outlet;

a water circulation system being to guide heated liquid flow to pass through the tower to perform heat exchanging process and to let the cooled liquid flow run out of the tower into a water storage tank consisted therein;

a vertical injection tubular element being set in the air inlet and having an elongated slit made thereon along axial direction to serve as an injection nozzle, through which said elongated slit the heated liquid flow from said water circulation system is injected to form into a continuous screen of high velocity liquid flow;

a diffuser being set inside the tower and comprised of a front reducing area, a middle and a rear expanding area, said front reducing area being to help the continuous screen of high velocity liquid flow to suck in cooled air current, said middle and rear expanding areas being to help the mixing of the continuous screen of high velocity liquid flow with the induced cooled air current; and a turning vane being to guide the air current and the liquid flow, which pass through said diffuser, to respectively run in different directions so as to let the air current be exhausted through the exhaust outlet and to let the liquid flow run into said water storage tank.

2. A cooling tower according to claim 1, wherein a mist eliminator is set in said exhaust outlet, said mist eliminator being comprised of a plurality of corrugated strip elements arranged in parallel with one another.

3. A cooling tower according to claim 1, wherein a silencer is set by said air inlet and said injection tubular element.

4. A cooling tower according to claim 1, wherein an air filter is set to completely cover said air inlet.

5. A cooling tower according to claim 1, wherein said elongated slit is defined by two opposite, flexible and wedge-shaped strip elements, said two wedge-shaped strip elements being fixedly mounted on said injection tubular element.

6. A cooling tower according to claim 5, wherein a plurality of adjusting screws are mounted on said two wedge-shaped strip elements to adjust the width of said slit therebetween.

* * * * *